United States Patent [19]

Huhtala et al.

[11] Patent Number: 4,610,029

[45] Date of Patent: Sep. 2, 1986

[54] BAG TO BE CARRIED IN THE HAND AND PROCEDURE FOR MANUFACTURING THE BAG

[75] Inventors: Esko Huhtala; Markku Laaksonen; Matti Vaho; Johannes Karttunen, all of Pori, Finland; Gosta Eklund, Trinity, N.C.

[73] Assignee: Oy W. Rosenlew AB, Finland

[21] Appl. No.: 763,706

[22] Filed: Aug. 8, 1985

Related U.S. Application Data

[63] Continuation of Ser. No. 522,720, Aug. 12, 1983, abandoned.

[30] Foreign Application Priority Data

Sep. 29, 1982 [FI] Finland ..... 823330

[51] Int. Cl.[4] ..... B65D 33/02; B65D 33/08

[52] U.S. Cl. ..... 383/10; 493/210

[58] Field of Search ..... 383/9, 10, 119; 493/189, 210

[56] References Cited

U.S. PATENT DOCUMENTS

| | | | |
|---|---|---|---|
| 2,182,261 | 12/1939 | Maas | 383/10 |
| 3,070,278 | 12/1962 | Korn | 383/9 |
| 3,089,635 | 5/1963 | Kugler | 383/9 |
| 3,140,039 | 7/1964 | Conti | 383/9 |
| 3,206,105 | 9/1965 | Smith | 383/10 |
| 3,300,120 | 1/1967 | McColgan | 383/9 |
| 3,462,069 | 8/1969 | Suominen | 383/10 |
| 3,765,597 | 10/1973 | Brieske | 383/9 |
| 3,974,958 | 8/1976 | Ruda | 383/9 |

*Primary Examiner*—Stephen P. Garbe

*Attorney, Agent, or Firm*—Steinberg & Raskin

[57] ABSTRACT

A plastic bag to be carried in the hand and a method for manufacturing the plastic bag are disclosed. The plastic bag comprises a top part, a jacket part and a bottom part. The top part is provided with a carrying aperture or the like and the bottom part is provided with a filling valve or the like by which the plastic bag can be filled with bulk material. The top part of the plastic bag is formed by a transverse seam and a reinforcing patch attached to one side of the upper end of the bag whereby the top part includes three material plies. A reinforcing patch can be attached to both sides of the upper end of the bag so that the top part is constituted by four plies. In the case where the plastic bag is intended for carrying larger quantities of bulk material, the top part of the plastic bag is formed by at least one fold formed at the upper end of the bag to define a fold portion and the reinforcing patch joins the folded top portion to the jacket part and at the same time overlies at least a part of the transverse seam, the top part thus including at least five thicknesses of material.

12 Claims, 10 Drawing Figures

BAG TO BE CARRIED IN THE HAND AND PROCEDURE FOR MANUFACTURING THE BAG

BACKGROUND OF THE INVENTION

This application is a continuation of application Ser. No. 522,720 filed 8-12-83 now abandoned.

The present invention relates generally to bags adapted to be hand carriable (hereinafter "hand carry bags") which are formed of plastic, plastic-coated or plastic-laminated material (hereinafter generally referred to as plastic). More particularly, the invention relates to such hand carry plastic bags which include a top part, a jacket part and a bottom part, the top part of the bag being provided with a carrying member such, for example, as a carrying aperture or the like, and wherein the top part of the bag is formed at least in part by a seam extending transversely across the bag.

The present invention further relates to a method for manufacturing a plastic hand carry bag of the type described above including a top part, a jacket part and a bottom part, wherein the top part of the bag is provided with a carrying member, such as a carrying aperture or the like, and moreover, wherein the bottom part of the bag is provided with a filling valve or the like by which the bag can be filled with bulk goods.

Plastic bags of the type described above are used for various purposes, such as for the storage and transport of bulk goods, such as chemicals, fertilizers, cement products and the like. Depending upon the quality and the intended use of the bulk goods, the hand carry plastic bag is generally designed for the storage and transport of bulk goods weighing in the range of about 5–25 kg.

The major drawback of conventional bag constructions of the type described above is the insufficient strength of the top part of the plastic bag. For example, in prior art designs, plastic bags have been manufactured wherein the top end of the plastic bag is folded double whereupon crosswise seams are formed in the folded top end to form a four-ply seamed construction. A carrying aperture is subsequently formed in the top part. However, the strength of the top part of plastic bags constructed as described above is insufficient since the strength of the top part substantially exclusively depends solely on the strength provided by the hot-seaming process.

A bag construction is disclosed in U.S. Pat. No. 3,974,958 wherein the top end of the bag is formed of a plurality of material thicknesses or plies which have been hot-seamed together. The bag disclosed in this patent is a so-called open bag which is filled through the bottom and closed by hot-seaming.

A bag is disclosed in E. P. Application No. 0 054 297 having a construction whose object is essentially to reinforce the carrying aperture of the bag. This prior art construction does not attempt to reinforce the seam forming the top part, such seam being made after a patch has been previously glued to the bag structure. This results in an undesirable diminution in the strength of the bag by amounts of up to 30% since each seaming operation will reduce the strength by about that amount.

A construction of a hand carry bag is disclosed in Finnish Patent No. 45539 wherein a cardboard reinforcement is provided at the top part of the bag and wherein a hanger catch is provided in a channel in the top part of the bag.

British Pat. No. 1,141,841 discloses a so-called open bag in the upper part of which a channel is formed by means of seams in which cardboard stiffeners are situated. A carrying aperture is formed in the bag. The stiffeners situated in the channel operate in the same manner as those disclosed in Finnish Patent No. 45539, described above.

A hand carry bag is disclosed in German Application Print No. 2 357 667. The top part of the bag comprises a folded top portion which has been seamed. No valve means are provided in the bottom part of the bag.

SUMMARY OF THE INVENTION

It is an object of the present invention to provide new and improved hand carry bags of the type formed of plastic.

A more detailed object of the present invention is to provide a new and improved hand carry bag of the type formed of plastic wherein the strength of the top part of the bag is considerably greater than in prior art constructions.

Briefly, in accordance with the apparatus of the present invention, these as well as other objects are attained by providing a hand carry bag wherein the top part of the bag is formed at least in part by a seam extending transversely across the bag and wherein the top part is further formed by at least one fold formed at the upper end of the bag defining a fold portion, the fold portion being connected to the jacket part by means of a reinforcing patch which at the same time overlies and is attached to at least a part of the transverse seam in order to improve its strength.

The reinforcing patch can be attached to only a single side of the top part of the bag as described above. Alternatively, reinforcing patches can be provided on both sides of the top part of the bag.

It is still another object of the present invention to provide a new and improved method of manufacturing a hand carry bag of the type described above.

In particular, it is an object of the invention to provide a method which will increase the strength of the top part of the band carry plastic bag by means of a relatively simple procedure and which can be accompanied substantially without manual intervention.

These objects of the invention are attained by a method wherein transversely extending seams spaced longitudinally from each other are formed along the length of an initially flat tubular web whereupon blanks are formed, each blank having a transverse seam joining two adjacent plies of the blank along narrow opposed regions thereof at an upper part of the blank. The adjacent plies form a two-ply main course. A reinforcing patch is attached to the upper part of the blank to form the top part of the bag having at least three plies and is also attached to at least a portion of the transverse seam to reinforce the same and improve its strength. A bottom is then formed on the bag blanks and a carrying member is formed on the top part.

In the case of larger size hand carry bags intended to carry larger quantities of material, prior to attaching the reinforcing patch, at least one fold is formed in the upper end of the blank to define a fold portion in addition to a first portion of said two-ply main course situated directly above said seam, so that with the reinforcing patch, the top part has at least five plies. The fold portion is folded from the two-ply main course to overly the first portion thereof. The fold portion terminates at a transverse upper edge of the blank which is situated above and proximate to the transverse seam. The transverse seam is spaced below and extends substantially parallel to the upper blank edge.

The reinforcing patch can be attached on only one side of the top part or, alternatively, a reinforcing patch can be attached to both sides of the top part. The upper end of the blank is preferably folded only after the transverse seam has been formed, so that the only interconnection between the fold portion and the first portion of the two-ply main course, besides along the fold thereof, is through the reinforcing patch (i.e., the first and fold portions are not additionally heat sealed together). The reinforcing patch may be attached to at least part of the seam before the upper end of the blank is folded.

Several significant advantages are obtained by the hand carry plastic bag and method of manufacturing the same according to the invention. In particular, the strength of the top part of the hand carry plastic bag is greatly increased by the invention through the provision of the combination of hot-seaming and through the affixation of a separate reinforcing patch, the reinforcing patch being connected to the top part of the bag by suitable conventional means such, for example, as by gluing. The glue can be applied both on the tubular bag blank and on the reinforcing patch. Moreover, since the transverse seam is formed in the bag prior to filling the bag in accordance with the invention, a relatively good, leak-free seam is obtained which results in the lack of any possibility of dust problems during use.

The advantages provided by the invention result from the operative combination of the features as follows. Firstly, the formation of the top part to include at least one fold at the upper end of the bag provides the carrying aperture with an enhanced strength as a consequence of which the strength of the aperture need not be additionally improved with the aid of the patch. Secondly, the patch functions to join the fold portion of the top part of the jacket. Thirdly, at the same time, the patch advantageously covers the transverse seam and thus increases its strength such as up to 25%, particularly in the case where the patch has a transverse length equal to that of the entire seam. These essential characteristic features of certain embodiments of the invention are not disclosed in E. P. Application No. 0 054 297.

Hand carry plastic bags of smaller size intended for the storage and transport of bulk goods in quantities ranging between about 5–10 kg, may be manufactured without the folding step described above in which case the structure of the top part of the bag comprises three plies of material, or four plies in the case where a reinforcing patch is affixed on both sides of the top part of the bag.

On the other hand, larger size plastic bags intended for quantities of bulk goods ranging about 10–25 kg, are advantageously manufactured such that prior to affixing the reinforcing patch to the top part of the bag, the upper end of the bag is folded to provide that the top part of the finished plastic bag will have five plies. In the case where a reinforcing patch is affixed to both sides of the top part, the latter will have a six ply construction. Where operational requirements are still greater, the top part of the bag can be folded twice or even more prior to affixing the reinforcing patch whereby the top part will have seven or eight material plies or even more whereby the strength of the top part of the hand carry plastic bag is even further enhanced.

In certain embodiments wherein the plastic bag is filled with bulk goods of great weight or where a filled plastic bag is to be transported over large distances, the provision of suitable stiffening components in the top part of the bag is recommended.

BRIEF DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
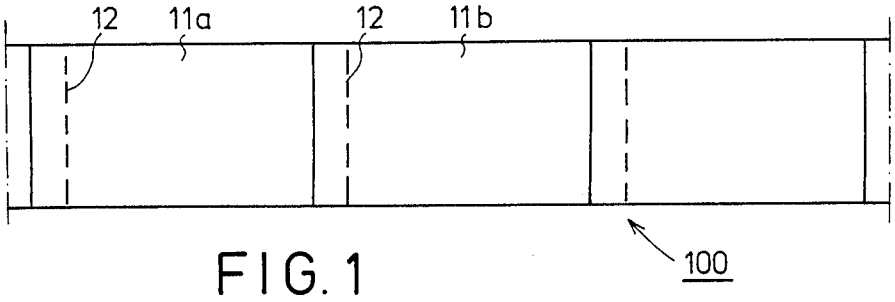
FIG. 1 is a schematic plan view of a flat plastic tubular web provided with transverse seams spaced from each other by a certain longitudinal distance and prior to the formation of the bag blanks therefrom.

Referring now to the drawings wherein like reference characters designate identical or corresponding parts throughout the several views, and more particularly to FIG. 1, a flattened tubular plastic web, generally designated 100, has a series of transverse seams 12 formed at substantially equal spacing from each other by the conventional hot-seaming technique as will be understood by those skilled in the art. For example, a heated bar can be contacted with the tubular web to form the respective seams 12 by fusing the opposed plies together. Individual plastic bag blanks 11*a*, 11*b*, etc., are formed by cutting the web at transverse lines substantially parallel to the seams 12 and longitudinally displaced somewhat from respective seams. Thus, the cuts formed in the tubular web can constitute a substantially transverse upper edge of the blank so formed. As noted above, each transverse seam 12 joins two plies of material together.

Figure 2A:
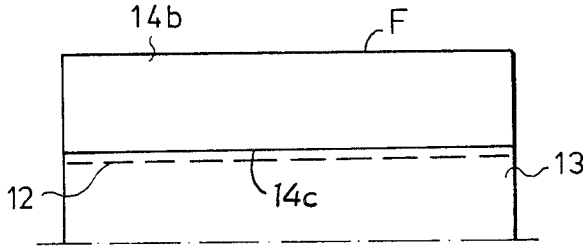
FIG. 2*a* is a partial plan view of an upper end region of a bag blank in accordance with the invention wherein a fold is formed in the construction of the top part of the bag.
Figure 2B:
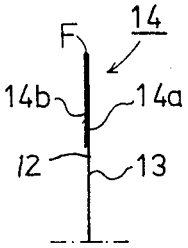
FIG. 2*b* is a schematic side elevation view of the construction illustrated in FIG. 2*a;*
Figure 2C:
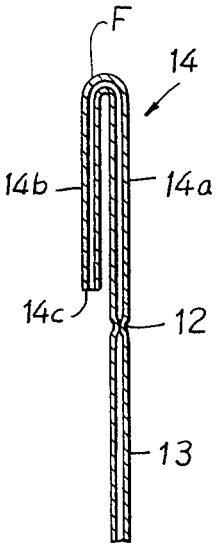
FIG. 2*c* is a view similar to FIG. 2*b* and showing the plies of the bag blank.

Referring to FIGS. 2*a*–2*c*, in the illustrated embodiment, the plastic bag blank is folded double upon itself so that the top part 14 of the bag includes overlying material courses 14*a* and 14*b* which together form a two-ply main course. Reference numeral 13 indicates the jacket part of the bag construction.

Still referring to FIGS. 2a–2c, the top part 14 of the bag is formed by a substantially transverse seam 12 which joins adjacent plies of the blank together along narrow opposed regions thereof as best seen in FIG. 2c, the seam 12 extending substantially parallel to the upper edge 14c of the blank. At least one fold F is formed in the upper end of the blank defining a first portion 14a of said two-ply main course directly above the seam 12 and a second or fold portion 14b, the fold portion 14b herein being constituted by the two-ply material course 14b which overlies the underlying two-ply material course 14a. The fold portion 14b terminates at the transverse upper blank edge 14c which is situated proximate to the transverse seam 12, as best seen in FIGS. 2a and 2c, and somewhat above the same. The fold F is preferably formed only after the seam 12 has been formed, such that there is no other heat sealing interconnection between the various plies, courses, or portions above the seam 12.

Figure 3A:
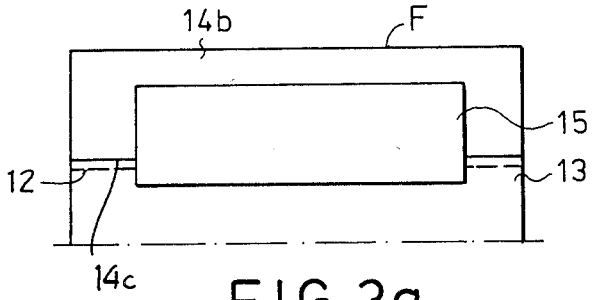
FIG. 3*a* is a top plan view of the top part of a bag constructed in accordance with the invention and wherein the fold portion shown in FIG. 2*a* is joined to the jacket part by a separate reinforcing patch 15.
Figure 3B:
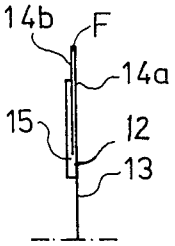
FIG. 3*b* is a schematic side elevation view of the construction of FIG. 3*a;*
Figure 3D:
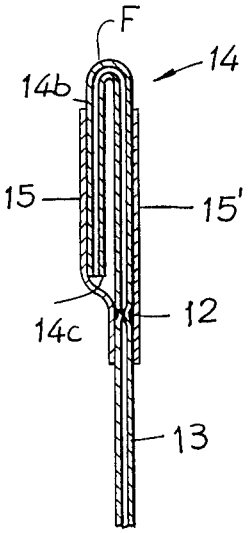
FIG. 3*d* is a view similar to FIG. 3*c*, illustrating an additional reinforcing patch 15' affixed to the opposite side of the top part of the bag from the first reinforcing patch 15.
Figure 3C:
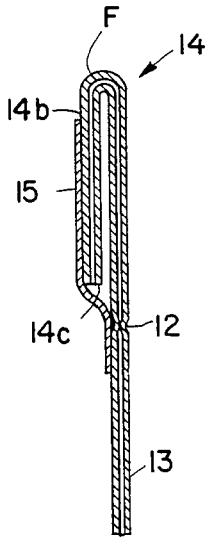
FIG. 3*c* is a view similar to FIG. 3*b* wherein the ply construction is illustrated.

Referring now to FIGS. 3a–3c which illustrate the next step in the method of manufacturing the bag in accordance with the invention, the top part 14 of the bag is formed by the attachment of a reinforcing patch 15, such as by gluing, to the side of the top part 14 on which the fold portion 14b is situated. In this case, the top part 14 will have a five ply construction. Alternatively, an additional reinforcing patch 15' (FIG. 3d) can be affixed to the opposite side of the top part 14 whereupon the top part will have a six ply construction.

Thus, still referring to FIGS. 3a–3c, the reinforcing patch 15 at least partially overlies and is attached to the fold portion 14b and to the jacket part 13 to join the same to each other. At the same time, the reinforcing patch 15 overlies at least a part of the transverse seam 12 and is also attached to at least a portion of the transverse seam 12 to reinforce the same and improve its strength. Thus the only additional interconnection between the fold portion 14b and the first portion 14a of the two ply main course, besides along the fold F, is through the reinforcing patch 15 (i.e., portions 14a and 14b are not additionally heat sealed together).

Figure 4:
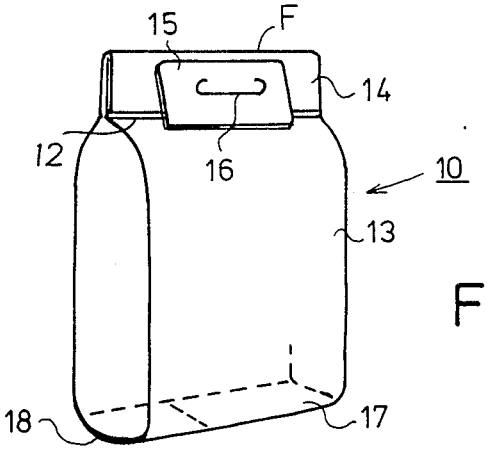
FIG. 4 is an axonometric perspective view of a preferred embodiment of a hand carry plastic bag constructed in accordance with the invention.

According to the next step of the method of the invention, the bottom construction of the plastic bag is provided as seen in FIG. 4 and as known per se in the art. A bottom construction 17 is provided with a filling valve 18 or the like by which the plastic bag 10 can be filled with bulk goods.

In the last step of the method, the top part 14 of the plastic bag 10 is provided with a carrying aperture 16 which in the embodiment illustrated in FIG. 4 is formed by piercing the top part 14 of the plastic bag 10 through the reinforcing patch 15 and the various material plies under the reinforcing patch.

The advantages obtained by the construction of the invention arise through the combination of operative features described above. The folding of the upper end of the bag blank to provide the fold portion provides the carrying aperture formed by piercing the folded top part with greater strength, the provision of the reinforcing patch further enhancing the strength of the top part and carrying aperture formed therein. The reinforcing patch further acts at the same time to join the fold portion to the jacket and, additionally, to cover the transverse seam to thereby significantly increase the strength thereof.

Figure 5:
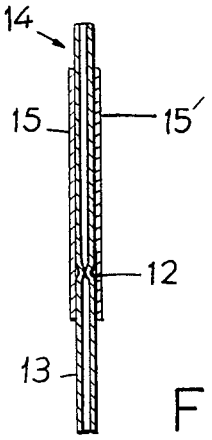
FIG. 5 is a partial side elevation view of the top part of another embodiment of a hand carry plastic bag constructed in accordance with the invention.

Hand carry plastic bags of smaller size intended for storing and transporting bulk goods in the range of between about 5–10 kg, can be manufactured without the necessity of providing a fold portion in the top part 14. As best seen in FIG. 5, the structure of the top part 14 will comprise three plies in the case where only a single reinforcing patch 15 is used. In the case where a reinforcing patch 15' is attached to the other side of the top part 14, the latter will have a four ply construction.

Larger size plastic bags 10 intended for transporting and storing bulk goods in the range of between about 10–25 kg, are advantageously so manufactured that prior to attaching the reinforcing patch 15, the top part 14 of the plastic bag is formed by folding the upper end of the bag blank whereby the completed plastic bag 10 will have five ply construction or six plies in the case where a reinforcing patch 15 is attached to both sides of the top part 14. Where the load bearing requirements are even greater, the top part 14 may be formed by folding the upper end of the bag blank two or more times before attaching the reinforcing patch 15 whereby the top part 14 will, accordingly, have seven or eight or even more ply constructions whereby the strength of the top part 14 of the hand carry plastic bag is even further increased.

In the case where the plastic bag 10 is filled with bulk material of very great weight or a filled plastic bag 10 is to be transported over relatively great distances, it is preferred that a suitable stiffening component be used in the top part 14.

Only a limited number of advantageous embodiments of the hand carry plastic bag of the invention and the method of making the same have been disclosed hereinabove. Of course, the invention is not limited to the particular order of the method steps described above, it being understood that the order of the method steps can be varied so long as the advatages obtained by the invention are achieved.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a hand carry bag constructed of a pair of adjacent plies of plastic material forming a two-ply main course, said bag including a top part, and a bottom part, and an intermediate jacket part, said top part having a carrying aperture formed therein, and wherein a seam joining said adjacent plies along narrow opposed regions thereof extends transversely across said bag to close said top part, the improvement comprising:

said top part includes a first portion of said two-ply main course situated above said seam and which has a first pair of mutually adjacent plies and at least one fold portion constituting a second portion of said two-ply main course situated above said seam and which has a second pair of mutually adjacent plies, said fold portion being folded from said two-ply main course to overlie said first portion of said two-ply main course;

a reinforcing patch having respective regions which at least partially overlie and are attached to said fold portion of said top part and said jacket part to join the same to each other, said reinforcing patch at the same time overlying and being attached to at least a part of said transverse seam to reinforce the same and improve its strength.

2. The combination of claim 1 wherein said reinforcing patch is attached to one side of said top part of said bag.

3. The combination of claim 2 wherein a second reinforcing patch is attached to the other side of said top part of said bag.

4. The combination of claim 1 wherein the bag is formed of an initially flat blank having a substantially transverse upper edge;

said seam spaced below and extending substantially parallel to said upper blank edge; and said fold portion terminating at said transverse upper blank edge which is situated above and proximate to said transverse seam.

5. The combination of claim 4 wherein a reinforcing patch is attached to the other side of said top part whereby said top part includes at least six plies.

6. The combination of claim 1, wherein said reinforcing patch constitutes the only other means of interconnection between said first and fold portions, in addition to the fold between these two portions.

7. A method of manufacturing a hand carry bag from a blank having a substantially transversely extending upper edge and a pair of plies of plastic material forming a two-ply main course, the bag including a top part, a bottom part and an intermediate jacket part, said top part having a carrying aperture formed therein, said bottom part being provided with filling means for filling the bag with bulk goods, comprising the steps of:

forming a transversely extending seam joining opposed narrow regions of the two plies of the blank at an upper part of said blank and spaced from the upper blank edge to define a first portion of said two-ply main course situated above said seam and which has a first pair of mutually adjacent plies;

folding said two-ply main course to form a second fold portion of said two-ply main course situated above said seam and overlying said first portion of said two-ply main course, said second fold portion having a second pair of mutually adjacent plies, the fold portion terminating at the transverse upper blank edge which is situated proximate to and above said transverse seam; and attaching a reinforcing patch such that respective regions thereof at least partially overlie and are attached to the fold portion of the top part and the jacket part to join the same to each other and at the same time so that the reinforcing patch overlies and is attached to at least a part of the transverse seam.

8. The method of claim 7 wherein the reinforcing patch is attached only on one side of said top part.

9. The method of claim 7 comprising the additional step of attaching a second reinforcing patch to a side of the top part opposite the first reinforcing patch.

10. The method of claim 7 wherein said two-ply main course is folded after forming said transverse seam.

11. The method of claim 7 wherein said reinforcing patch is attached to at least a part of the transverse seam prior to said two-ply main course being folded.

12. The method of claim 7, wherein said reinforcing patch is attached after said two-ply main course is folded.

* * * * *